United States Patent [19]

Schnitzer

[11] Patent Number: 4,745,835

[45] Date of Patent: May 24, 1988

[54] FINE TOOTH PERFORATION FOR WEBS

[75] Inventor: David H. Schnitzer, Palatine, Ill.

[73] Assignee: Uarco Incorporated, Barrington, Ill.

[21] Appl. No.: 302,571

[22] Filed: Sep. 15, 1981

[51] Int. Cl.[4] ..... B26F 1/20

[52] U.S. Cl. ..... 83/678; 83/660; 281/2

[58] Field of Search ..... 83/678, 660; 281/2

[56] References Cited

U.S. PATENT DOCUMENTS

| | | | |
|---|---|---|---|
| 3,978,783 | 9/1976 | Meaden et al. | 83/678 |
| 4,074,599 | 2/1978 | Allen | 83/678 |
| 4,188,251 | 2/1980 | Grass et al. | 83/678 U X |

*Primary Examiner*—Donald R. Schran

*Attorney, Agent, or Firm*—Wood, Dalton, Phillips, Mason & Rowe

[57] ABSTRACT

A perforating blade for creating extremely fine perforations in plural plies of a multiply ply paper construction including a perforating edge defined by a plurality of perforating elements separated by notches. Preferably there are about 50 or more of each of the elements and the notches per lineal inch with the notches having a length along the cutting edge of no more than about 0.010 inches. A relatively small number of the perforating elements, at generally uniformly spaced locations along the edge have lengths of about 0.03 inches or more with the remainder of the elements having lengths substantially less than 0.03 inches. The blade provides lines of perforation that when separated, have the appearance of the edge of a so-called cut sheet.

7 Claims, 1 Drawing Sheet

FINE TOOTH PERFORATION FOR WEBS

FIELD OF THE INVENTION

This invention relates to the provision of fine perforations in webs, such as paper, and more specifically, to a perforating blade for providing such perforations and to a business form provided with such perforations.

BACKGROUND ART

It has long been commonplace to provide webs, such as paper webs, or sheets with lines of weakness whereby one part of the web or sheet may be separated from another. In most cases, lines of perforations are utilized for this purpose. The perforations are typically formed by a series of cuts extending through the web or sheet separated by ties, or unsevered portions of the web or sheet. Perforations heretofore used have ranged from rather coarse to so-called fine or "keen" perforations with the characterization being dependent upon the length of the tie along the line of perforation, and, to a lesser extent, the number of cuts per lineal inch of the line of perforation. In typical commercial practice, the finest perforation employed has a tie length in the range from about 0.024–0.040 inches and frequently, but not always, will be found as a result of forming the perforations with a blade having seventeen teeth per inch with each tooth having a cutting length of about 0.027 to 0.035 inches.

While such lines of perforation have functioned well for their intended purpose of allowing separation of webs along such lines, in many applications, they are not altogether acceptable. For example, and as is well known, in separating a business form along a line of perforation, the ties, during the process of being ruptured, and due to the fibrous nature of the paper, tend to pull outwardly of and extend past the straight cuts in the line of perforation with the consequence that an unsightly edge results. The edge is ragged as a result of the extended, ruptured ties and the relatively smooth cuts inbetween the ties. In cases where the forms are used for mass mailings or the like being processed on computer printers or tabulators, it is apparent to the recipient that the form is part of a mass mailing as opposed to a personal letter.

Consequently, to provide a more personalized appearance, business forms have been developed wherein an ordinary cut sheet business form, such as a letterhead, is "tipped on" to a paper carrier or web provided with control punch margins to facilitate computer processing. The carrier web is fed through the printer carrying with it the cut sheet letterhead which is then imprinted upon. Following the printing operation, the letterhead is removed from the carrier strip and stuffed into an envelope for mailing. The carrier strip is then discarded. Obviously, this procedure wastes approximately one half of the paper involved in the business form, which wastage could be avoided if the letterheads could be made up as continuous business forms with control punch margins and separated into individual form lengths with the control punch margins removed and still retain the appearance of a cut sheet. Furthermore, because of the nature of the paper used in some products, it is neccessary to provide a punched perforation as, for example, commonly used in postage stamps. In some papers, and dependent upon the direction of the line of perforation, the fibers may not run parallel to or with the line of perforation. Consequently, strong fibers in a tie running across the line of perforation may cause the tearing of the tie to "wander" off of the line of perforation and actually tear into the edge of the paper, again, resulting in an unsightly appearance. Consequently, punched perforations have been used in order to provide a large cut or hole into which the tear may wander when a strong fiber or fibers are approached so that the tear, upon encountering the next tie, is automatically realigned on the line of perforation. Of course, punched hole perforations provide an even more unsightly edge than those encountered when separating a web or the like along a line of perforation formed of cuts and ties. Moreover, the equipment required to form punched hole type perforations is quite expensive and extremely costly to maintain.

The present invention is directed to overcoming one or more of the above problems.

SUMMARY OF THE INVENTION

It is the principal object of the invention to provide a new and improved line of perforation for use in webs. More specifically, it is an object of the invention to provide a new and improved line of perforation that, when torn, results in edges that closely approximate the edge of so-called "cut sheets"; and eliminates the need for the use of punched hole type perforations and the attendant equipment costs. It is also an object of the invention to provide a blade for providing such lines of perforation.

According to one facet of the invention, there is provided a blade for perforating webs or the like which has a perforating edge defined by a series of tooth-like perforating elements separated by notches. The length of each of the majority of the perforating elements along the edge is no more than about 0.02 inches and the width of each notch between the cutting elements is no more than about 0.01 inches along the length of the edge.

According to another facet of the invention, there is provided a paper product, such as a business form, including at least one web or sheet of paper having a line of perforations formed by cuts through the paper separated by ties, along which one part of the web may be separated from the remainder thereof. The invention contemplates the improvement wherein the ties have a length along the line of perforation of no more than 0.010 inches and wherein there are sufficient number of the ties along the line of perforation to provide a burst strength in the range of about 8–20 pounds per two lineal inches of length of the line of perforation. One part of the web or sheet may be separated from the remainder thereof along the line of perforation without appreciably visible breakage of the ties to provide a smooth edge resembling the cut edge of a so-called "cut sheet".

Such a line of perforation, because of the short length of the ties, is not prone to wandering of the tear during separation and therefore may be utilized in applications heretofore requiring punched hole perforations.

Other objects and advantages of the invention will become apparent from the following specification taken in connection with the accompanying drawings.

BEST MODE FOR CARRYING OUT THE INVENTION

Figure 1:
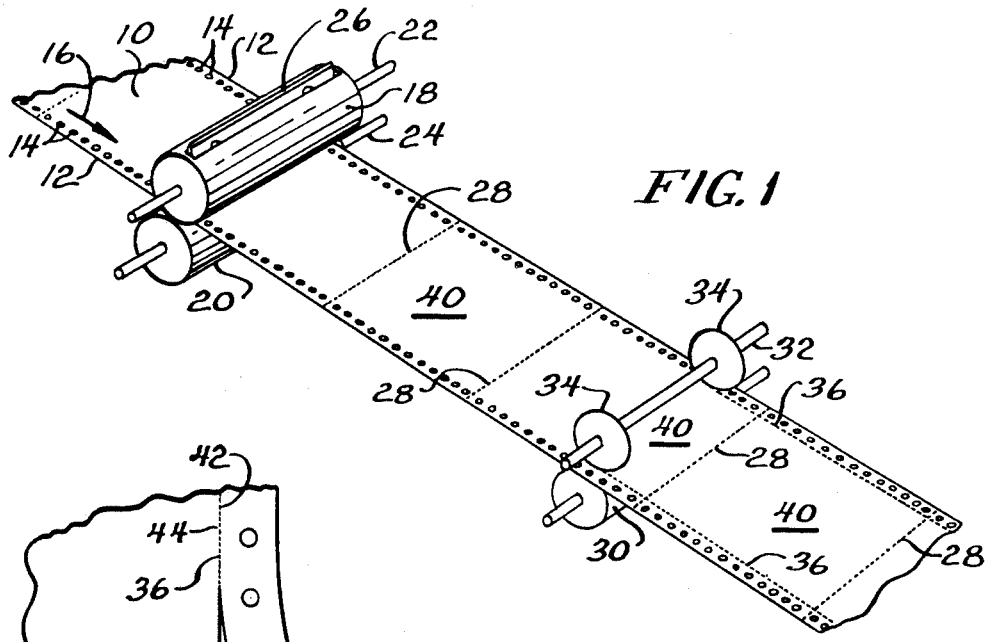
FIG. 1 is a somewhat schematic view of the manufacture of a business form made according to the invention utilizing perforating blades made according to the invention.

An exemplary embodiment of a web product made according to the invention is illustrated in the process of manufacture in FIG. 1. As illustrated, a web of paper utilized in the manufacture of a continuous business form is shown. However, it is to be understood that the principles of the invention may be utilized in other than continuous business forms, such as so-called unit sets or cut sheets, where lines of perforation are required therein. It is also to be understood that the invention may be employed in providing lines of perforation in webs of material other than paper as, for example, plastic, and further, that the lines of perforation may also be useful in products where separation along the line of perforation is not required as, for example, in forming, under relatively close tolerances, aspirator holes in the wrappings for filters on cigarettes.

In FIG. 1, a continuous web of paper is designated 10 and along its longitudinal margins 12 is provided with control punch openings 14 used for conventional purposes in both manufacture and processing. The web 10 is passing through manufacturing equipment in the direction of an arrow 16 and passes first to a perforating cylinder 18 operating in conjunction with an anvil cylinder 20 both of which revolve about respective rotational axes 22 and 24 in timed relation with the movement of the web 10.

The perforating cylinder 18 carries one or more perforating blades 26 made according to the invention which periodically come in contact with the web 10 to penetrate the same and bear against the anvil cylinder 20 to thereby form transverse lines of perforation 28 in the web. Other than the cutting edge on the blade 26, the equipment utilized is conventional, is set up in the conventional fashion according to known procedures, and is otherwise operated in a conventional way.

After leaving the perforating cylinder 18, the web 10 moves onwardly to a further anvil cylinder 30 located below the web. Above the web, a rotary shaft 32 mounts a pair of perforating wheels, each designated 34. The perforating wheels 34 cooperate with the cylinder 30 so as to provide longitudinal lines of weakening 36 just inwardly of the margins 12 and the control punch openings 14 in the web 10. As is well known, after the business form thus provided is processed by a purchaser thereof, the control punch margins will be removed along the longitudinal lines of perforation 36 and the web will be separated along the transverse lines of perforation 28 to provide individual form lengths 40.

Figure 2:
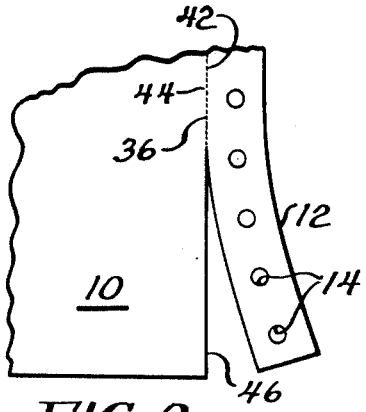
FIG. 2 is a fragmentary view of the partial separation of a control punch margin from a business form along a line of perforation made according to the invention utilizing a blade made according to the invention.
Figure 3:
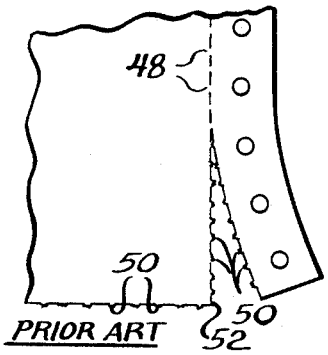
PRIOR ART FIG. 3.
FIG. 3 is a view similar to FIG. 2 but illustrating a prior art product.

According to the invention, each of the lines of perforation 28 and 36 is formed of alternating cuts extending through the web 10 shown at 42 in FIG. 2 which are separated by very small ties, shown at 44. As also seen in FIG. 2, wherein the line of perforation 36 is specifically illustrated and wherein the web 10 is partially severed thereon, the resulting edge 46 is quite smooth and upon normal visual inspection, will have the appearance of the cut edge of a cut sheet product. While not illustrated in FIG. 2, the edges of the web, when severed on the lines of perforation 28 will have the same appearance. This results as, according to the invention, the length of each tie 44 along the line of perforation 28 or 36 is no greater than about 0.010 inches, and preferrably, it is no greater than about 0.008 inches. In almost all types, grades and weights of paper, if the tie length is greater than 0.010 inches, the noticeable jagged edge typically associated with prior art lines of perforation, such as is illustrated in FIG. 3, begins to appear. In such a case, the prior art ties 48, due to the fibrous nature of the paper, tend to pull out as the tear is formed resulting in a series of small stubs 50 extending from the edge 52 of the tear. In some types of paper, the undesirable jagged edge appearance of the prior art will become apparent when the tie length exceeds 0.008 inches. Thus, a tie length of 0.010 inches will be satisfactory in some instances whereas a maximum tie length of 0.008 inches will provide a commercially satisfactory product in virtually every instance.

Of further concern in the manufacture of a product made according to the invention, is the fact that the lines of weakening 28 and 36 must not be made so weak as to allow inadvertent rupture of the ties during manufacture and/or subsequent use or processing. For example, computer printers typically jerk a business form being imprinted upon at a relatively high frequency, accelerating the paper to advance a new line to the printing mechanism and then decelerating the same to allow printing to be performed. If one of the lines 36, in whole or in part ruptures, feeding is impaired. Conversely, if one of the transverse lines 28 in whole or in part ruptures, there is provided an edge which may snag within the innards of the computer printer thereby causing a shutdown.

Moreover, as is well known, many continuous business forms are zig-zag folded for packaging and shipment and such folding occurs on the transverse lines of weakening 28. The folding, of course, weakens some of the fibers with the consequence that if the lines 28 are made too weak, some breakage of the lines may be expected to occur in folding with the results that the loose edge, when the form is processed by a customer, may snag within the innards of the printer.

On the other hand, it is undesirable to have the lines of weakening 28 and 36 provided with too great of strength otherwise removal of the control punch margins and/or the bursting of the web 10 into individual form lengths 40 cannot be reliably performed.

Thus, according to the invention, the ties 44 in the form made according to the invention are provided in sufficient number so that the line of perforation has a burst strength of about 8–20 pounds per two lineal inches of the length of the line of perforation, as measured on a conventional perforation strength tester. Thus, the major considerations are maximum tie length and burst strength as outlined above. However, there remains a further consideration as well. Assuming the material of a given web would allow the burst strength characteristics required to be met with ties appreciably smaller than 0.010 inches, it has been visually determined that where the length of the cuts 42 begin to exceed 0.02 inches, the ragged edge appearance of the prior art as shown in FIG. 3 begins to become noticeable, albeit considerably less pronounced than in prior art structures. This is particularly true where the majority of the cuts 42 have a length in excess of 0.02 inches. Consequently, it is highly desirable that there be a minimum of 33 cuts per lineal inch of each line of perforation 28 or 36.

In the case of somewhat finer perforations, but not the finest contemplated according to the invention, it has been visually ascertained that an improvement in edge appearance obtains where the length of the cuts and the ties are approximately the same. Given a maximum tie dimension of 0.01 inches, and cuts of the same order, to achieve the uniformity in such a moderately fine line of perforation, there will preferably be at least 50 cuts per lineal inch of each line of perforation 28 or 36. With even finer lines of perforation made according to the invention, which optimally include 70 or more cuts per lineal inch of the lines of perforation 28 or 36, there is no requirement that the ties and cuts have dimensions on the same order.

It should be recognized that the principles set forth immediately preceding are general, as opposed to exclusive, for, as will be seen hereinafter, there are exceptions thereto.

Figure 4:
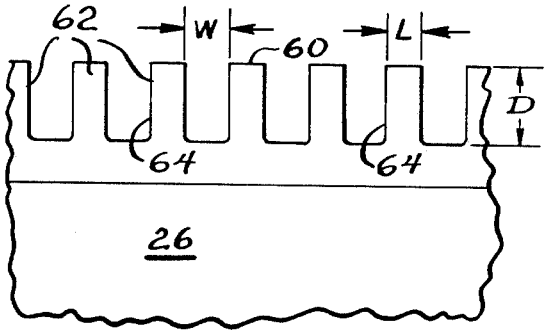
FIG. 4 is a fragmentary, considerably enlarged view, of a perforating blade made according to the invention.

Turning now to FIG. 4, the perforating edge of the perforating blade 26 is shown in detail, considerably enlarged. It will be understood that the rotary perforating blades or wheels 34 are identical to the perforating rule 26 with, of course, the exception that their perforating periphery is circular rather than linear. The blade 26 is preferably formed of conventional two or three point cutting rule such as "Sandvik" rule manufactured in Sweden and distributed in the United States by the Disston Corporation of Philadelphia, Pa. The apex or perforating edge is shown at 60, may be beveled on one side only, beveled on both sides only, or double beveled on both sides as is conventional. There is provided a plurality of tooth-like perforating elements 62 separated from each other by notches 64. The length of each tooth 60 is designated L in FIG. 4 while the depth of each notch 64 is shown at D. The width of each notch is shown at W and for purposes of definition herein is that dimension of the notch extending along the line of perforation and which provides the length of each tie 44 along such line. Thus, the dimension "L" defines the length of each cut 42 while the dimension "W" defines the length of each tie 44.

At this point, it should be noted that the perforation lines 28 and 36 in a single form may not always be identical due to differing strength requirements either in manufacture or in subsequent use in processing. For example, in the case of the manufacture of single ply business forms utilizing relatively positive folding apparatus such as jaw/tucker folders, a typical value of L would be 0.006 inches while W would be 0.008 inches. D would be selected to be 0.014 inches; and the blade is used to form the transverse lines of perforation 28. The same dimensions may be utilized in conjunction with the rotary perforating blades or wheels 34 in forming lines of perforation such as the lines 36.

Where lower perforation strength is required, as, for example, when less positive folding apparatus is employed, a typical value of L might be 0.008 inches while W would have a value of 0.006 inches with D remaining at 0.014 inches. In the case of transverse lines of perforation such as the lines 28, and where the form is not intended to be folded on such a transverse line, a typical value of W can be 0.005 inches with L having a value of 0.008 inches. D may remain at 0.014 inches.

Generally speaking, because there is no folding on the lines of perforation 36, they may be initially formed with lesser strength than the lines 28. In such a case, L would have a value of 0.010 inches while W would have a value of 0.004 inches with D again remaining at 0.014 inches for single ply forms. The resulting line of perforation may also be utilized advantageously on interior, so-called "vertical perfs" in multiple ply forms as well as on the so-called "stub perf" on unit sets.

In the foregoing examples, the value of D is given as 0.014 inches. This value is selected as it enables the blades to cut relatively heavy stock, such as tabulator cards, as well as thinner webs or sheets thereby providing greater blade versatility. However, where such versatility is not required, D may be selected to have a value of approximately twice the total thickness of the paper to be perforated and, in general, should not be less than about 0.005 inches greater than the total thickness of the paper to be perforated. Nonetheless, in instances where scoring of the ties is desirable for the purpose of weakening them to achieve a desired burst strength, or for other purposes, D may have a value less than the total thickness of the paper to be perforated.

The foregoing dimensions are achieved by appropriately forming the notches 64. One method of forming the notches to have the requisite dimensions is the use of conventional, wire type, electron discharge machining processes. However, it is believed that the notches 64 could likewise be formed utilizing laser cutting principles.

Figure 5:
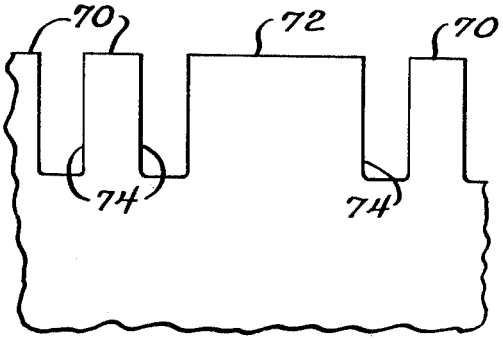
FIG. 5 is a view similar to FIG. 4 but showing a modified embodiment of the perforating blade.

Turning now to FIG. 5, a rule useful in forming the lines of perforation in multiple ply forms is illustrated. The rule illustrated in FIG. 5 includes two types of teeth, the first being designated 70 and the second being designated 72. The various teeth are separated by notches 74 and the same approach to dimensions mentioned in connection with the description of FIG. 4 is employed. In particular, the cutting dimension of the teeth 70, or L is 0.010 inches for the teeth 70 while W, or the tie dimension, will be 0.008 inches. The depth of the notches 74, or D, will be approximately 0.025 inches for a four ply business form and should generally be 0.005 inches greater than the total thickness to be perforated.

The length of L dimension of the tooth 72 is 0.032 inches and one of the teeth 72 is provided along the perforating edge every 0.255 inches, representing an exception to the preferred maximum tooth length of 0.020 inches. The purpose of this exception is to provide greater strength to the perforating edge. Because the depth of the notches 74 must necessarily be greater to cut through multiple plies of paper, the teeth 70 are more prone to be deformed under the pressure encountered when they contact the anvil cylinder 20 (FIG. 1). Consequently, wider teeth such as the tooth 72 are provided at intervals such as those mentioned above to increase resistance of the perforating edge to deformation. For the same reason, the L dimension of the teeth 70 is increased somewhat over that employed for the teeth 62.

Another exception to the general rule of tooth lengths not exceeding 0.020 inches will be found where perforation blades are utilized in die cutting. For example, die cuts will typically have round or squared corners and to form the corners properly, it may be necessary to greatly exceed a cut length of 0.020 inches at such corners. Moreover, in some instances, where the forms are provided with both the lines of perforation 28 and 36, that part of the lines of perforation 28 within the control punch margin, which will be separated from the form in any event, may be provided with cuts longer than 0.020 inches as well as ties having a greater dimension than 0.010 inches, since neither will affect the appearance of the finished form.

Other examples of specialized applications wherein the preferred dimensions may be exceeded will be appreciated by those skilled in the art.

From the foregoing, it will be appreciated that a perforation blade made according to the invention provides lines of perforation in webs, such as paper webs or sheets, that, when severed, result in edges of the finished product that closely resemble the edges of cut sheet products. Consequently, a more personalized and/or cleaner appearing business form results. Moreover, in the case of mass mailings or the like, the carrier strip may be discarded entirely providing a paper savings of up to 50%.

Further, there will be a savings in the manufacturing operation since the carrier strip need not be formed nor is it necessary to perform the step of tipping cut sheets onto a carrier web. The purchaser of the form may process the same more economically since he no longer is required to dispose of the carrier web.

The elimination of the carrier web reduces the thickness of a given number of individual form lengths thereby minimizing bulk in both storage and transportation. In the same vein, the weight of the carrier web is eliminated lowering transportation costs.

It will also be appreciated that because of the extremely short length of the ties 44, even the presence of extremely strong fibers in paper, which fibers are not extending generally parallel to the line of perforation, will not cause the tear to wander. Consequently, perforations of the type disclosed herein may be substituted for punched hole type perforations heretofore required in many applications, thereby avoiding the need for the purchase of specialized equipment to form such perforations and the extensive maintenance associated therewith.

I claim:

1. A perforating blade for creating extremely fine perforations in multiple ply business forms including a blade having a perforating edge made up of alternating perforating elements and notches separating the elements, said notches having a length along said edge no greater than about 0.010 inches and a depth of at least about 0.005 inches greater than the thickness of the multiple plies to be perforated, the length along said edge of a substantial majority of said elements being no more than 0.020 inches, at least certain of the remainder of said elements, located at relatively widely spaced intervals along said edges, having a length along said edge substantially in excess of said length of said substantial majority.

2. The perforating blade of claim 1 wherein the depth of said notches is 0.020 inches or more, and said length of said certain elements at least 0.03 inches.

3. The perforating blade of claim 1 wherein said notches have a length along said edge of no more than 0.008 inches and said length of said substantial majority of said perforating elements is about 0.010 inches.

4. A perforating blade for creating an extremely fine perforation in plural plies of a multiple ply paper construction comprising a blade having an elongated perforating edge, said edge being defined by a plurality of perforating elements separated by notches, there being at least about 50 of each of said elements and said notches per lineal inch of said edges, said notches having a length along said edge of no more than about 0.010 inches, a relatively small number of elements, at generally uniformly spaced locations along said edge having lengths along said edge of about 0.03 inches or more with the remainder of said elements having lengths along said edge substantially less than 0.03 inches.

5. The perforating blade of claim 4 wherein said blade is a rule.

6. The perforating blade of claim 4 wherein said blade is a wheel.

7. A perforating blade for creating an extremely fine perforation in plural plies of a multiple ply paper construction comprising a blade having an elongated perforating edge, said edge being defined by a plurality of perforating elements separated by notches, there being at least about 33 of each of said elements and said notches per lineal inch of said edge, said notches having a length along said edge of no more than about 0.010 inches, a relatively small number of elements, at generally uniformly spaced locations along said edge having lengths along said edge of about 0.03 inches or more with the remainder of said elements having lengths along said edge substantially less than 0.03 inches.

* * * * *